US006521907B1

(12) United States Patent
Shoaff et al.

(10) Patent No.: US 6,521,907 B1
(45) Date of Patent: Feb. 18, 2003

(54) MINIATURE PHOTOELECTRIC SENSING CHAMBER

(75) Inventors: Thomas W. Shoaff, Warrenville, IL (US); Kalvin Watson, Chicago, IL (US); Dragan Petrovic, Geneva, IL (US); George A. Schoenfelder, Batavia, IL (US); Frederick J. Conforti, Wheaton, IL (US); James F. Wiemeyer, Homer Township, IL (US)

(73) Assignee: Pittway Corporation, Chicago, IL (US)

( * ) Notice: Subject to any disclaimer, the term of this patent is extended or adjusted under 35 U.S.C. 154(b) by 0 days.

(21) Appl. No.: 09/556,210

(22) Filed: Apr. 24, 2000

Related U.S. Application Data

(60) Provisional application No. 60/131,654, filed on Apr. 29, 1999.

(51) Int. Cl.[7] ..... G08B 17/10

(52) U.S. Cl. ..... 250/573; 356/628; 250/574

(58) Field of Search ..... 250/573–576; 340/628, 630; 356/338, 436–439

(56) References Cited

U.S. PATENT DOCUMENTS

| | | | |
|---|---|---|---|
| 4,216,377 A | 8/1980 | Hasegawa et al. | |
| 5,138,302 A | 8/1992 | Nagaoka et al. | |
| 5,751,218 A | 5/1998 | Winterble et al. | |
| 5,751,219 A * | 5/1998 | Winterble et al. | 340/693 |

FOREIGN PATENT DOCUMENTS

| | | |
|---|---|---|
| AU | 725 417 | 10/1998 |
| EP | 0 800 153 A2 | 10/1997 |
| EP | 0 821 332 A1 | 1/1998 |

OTHER PUBLICATIONS

European Search Report dated Apr. 17, 2001 which issued on European counterpart Application No. EP 00 309 3627.

* cited by examiner

*Primary Examiner*—Stephone B. Allen

(57) ABSTRACT

A low profile, low volume smoke chamber displaces a light source, such as a light emitting diode or laser diode, and a sensor, such as photodiode or phototransistor, to the exterior of the sensing volume. A symmetrical sensing volume results which can be coupled to symmetrical input/output ports via a generally U-shaped flow path. A two part sensing chamber housing is formed with a lower cylindrical base portion and an upper cylindrical cover portion which slideably engage one another. At least the upper cylindrical portion carries a plurality of grooves for suppression of reflections and collection of dust. An exterior end of the upper portion carries a plurality of spaced apart openings which can be filled with a screen. A reduced sensing volume in combination with a selected screen size produces an acceptable signal to noise ratio and response rate while still excluding insects and other non-smoke related particulate matter.

57 Claims, 3 Drawing Sheets

FIG. 2
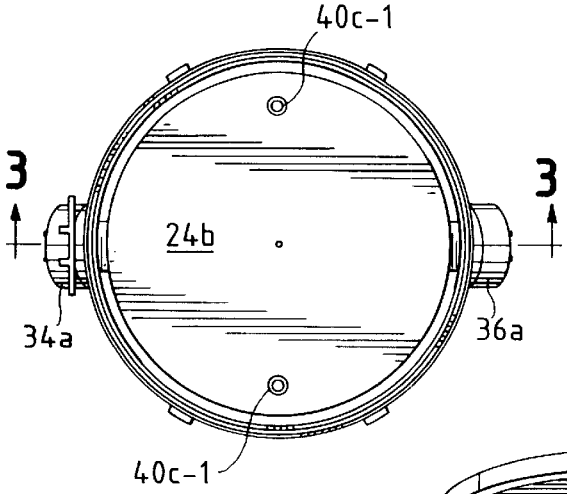
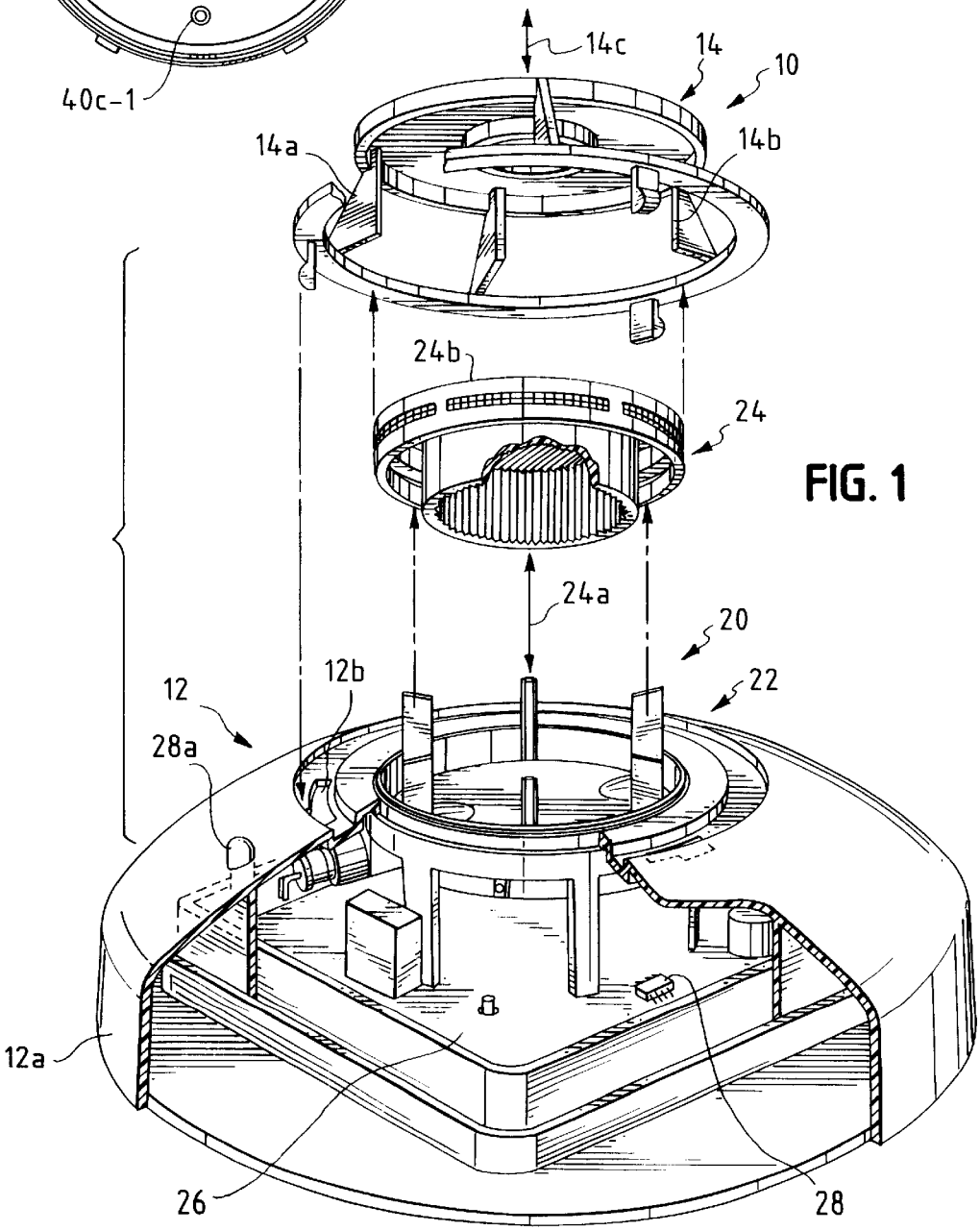
FIG. 1

MINIATURE PHOTOELECTRIC SENSING CHAMBER

The benefit of the filing date of Apr. 29, 1999 of Provisional Application Serial No. 60/131,654 for Fast Miniature Photoelectric Sensing Chamber is hereby claimed.

FIELD OF THE INVENTION

The invention pertains to smoke sensors of a type used in fire detectors. More particularly, the invention pertains to such sensors having a reduced size and a low profile.

BACKGROUND OF THE INVENTION

Fire or smoke detectors have become widely used elements of fire alarm systems. Such alarm systems often incorporate large numbers of such detectors spread over substantial regions to detect and track the build-up of smoke.

Known detectors while effective for their purpose have at times been regarded as less than aesthetically pleasing due to their profile and over-all size. There thus continues to be an on-going need for smaller detectors having lower profiles and a smaller over-all size.

While small chamber size has been recognized as being preferable from an aesthetic and architectural point of view, it has also been recognized that as chambers become smaller the signal to noise, ratio can potentially drop and become less than optimal. As chamber dimensions have become smaller, background light levels detected in photoelectric smoke chambers by the respective light sensitive element (such as a photodiode or a phototransistor) can increase significantly. There continues to be a need for smoke sensors which while physically small exhibit appropriate signal to noise ratios while minimizing nuisance alarms.

SUMMARY OF THE INVENTION

A photoelectric sensing chamber has a cylindrical shape with a relatively low profile. A base element is formed with a cylindrical region and a closed end. A cover has a hollow cylinder which extends therefrom. The cover slideably engages the base such that the distal end of the cylinder is located adjacent to the base. Together they form a substantially enclosed, cylindrical symmetrical sensing chamber. The chamber encloses a symmetrical sensing region.

The cover carries a plurality of openings at an exterior, proximal, end displaced from the distal end of the cylinder. The openings permit ingress and egress of adjacent ambient atmosphere, which could carry smoke or particles of combustion.

An annular flow path extends between the base and the cylinder, coupled to the openings. This path, around the cylinder and extending to the base couples the openings to the sensing region.

The cylinder cooperates with the base to form an inflow/outflow region between the annular flow path outside of the cylinder and the internal sensing region. This produces a more or less U-shaped flow path which is symmetrical around the sensing region.

The symmetrical flow path and symmetrical internal sensing region are achieved by displacing a source of radiant energy, such as a light emitting diode or laser diode and a sensor of scattered radiant energy, such as a photodiode or a phototransistor, into the base of the chamber outside of the internal sensing region. With this configuration, the shape of the source does not distort and detract from the symmetry of the sensing region. Similarly, by displacing the sensor into the base, its shape does not distort the symmetrical shape of the sensing region.

Each of the source and the sensor can be, in one aspect of the invention, located in conduits displaced from the sensing region. One conduit, in addition to supporting the source, provides a focusing function for the radiant energy being projected into the sensing region. Another provides a collecting function for scattered incident light directed to the sensor. This increases optical gain of the chamber.

In another aspect of the invention, protrusions can be provided in the conduit for the sensor to block a first reflection of light from the source off of the internal side wall of the sensing chamber to provide an enhanced signal to noise ratio. Such protrusions for example could occupy 20 to 40 percent of the area of the respective conduit to produce the noise suppressing function. A preferred percentage is on the order of 27 percent.

A protrusion in the conduit for the source cooperates with the interior geometry of the conduit to block and reflect a portion of the light injected through the conduit by the source. This also contributes to the enhancement of the signal to noise ratio.

The conduits are located at an angle relative to one another which corresponds to the primary scattering angle for the sensing chamber. In this regard, for laser sources, an angle can be established in a range of 20 to 30 degrees. A 25 degree angle is preferable. For infrared light emitting diodes, an angle can be established in a range of 40–45°.

In another aspect of the invention, the orientation of the conduits directs the beam of light from the source and directs the field of view of the light sensitive element toward opposite sides of the grooved interior surface of the chamber. The source projects a spot of radiant energy, or light, onto the opposite wall of the sensing chamber, the internal grooved side wall of the cylinder. Preferably in this embodiment, no light will illuminate the fringe of the cover cylinder. However, if due to component variations, emitted radiant energy illuminates the cover fringe, the above-noted protrusion in the conduit for the sensor should block any resultant stray light from reaching the sensor.

The opposite side of the cover cylinder, which is intersected by the optical axis of the sensor does not receive any direct illumination from the source. As such, the sensor is directed to a region having low levels of stray background light or radiant energy.

Hence, the orientation of the conduits taken together reduces the degree of stray background light or radiant energy which can find its way onto or into the light sensor. This in turn contributes to an enhanced signal to noise ratio and a detectable level of scattered light in response to smoke permeating the sensing region.

In another aspect of the invention, the inner surfaces of the side wall and the bottom of the chamber can be formed with grooves to promote absorption of light and to provide depressed regions for accumulating dust that has drifted into the sensing chamber.

In yet another aspect of the invention, the cylinder which extends from the cover has a continuous closed peripheral surface without perforations therethrough. Ambient atmosphere including ambient smoke, flows up and down the continuous side walls to and from the sensing region. Consequently, the cover, in yet another aspect of the invention, can incorporate a screen or a mesh at an exterior end thereof. Mesh openings can have a length in a range of 0.013" to 0.02" long.

The mesh can be inserted into the mold before the cover/cylinder are molded. Alternately, the openings can be molded into the cover without a separate mesh or screen.

The nested cylinders, namely the cylinder carried on the cover and the cylinder formed by the base provide a substantially continuous annular flow path into the sensing region unlike known multiple vane labyrinths which result in several, restricted flow paths into the sensing region. A substantially continuous opening around the exterior perimeter of the cover of the housing can be provided for ingress and egress of smoke.

Taking into account the above-noted characteristics and features, results in a sensing chamber height on the order of 0.7 inches or less with a diameter of less then 1.5 inches. This produces a sensing volume of less than 1.24 cubic inches and an optical spacing on the order of 1.35 inches.

The smaller sensing volume reduces time to respond to incoming ambient smoke. Additionally, a smaller mesh size can be used, thereby improving exclusion of insects and dust, while at the same time, the chamber still exhibits an acceptably short response time to ambient smoke.

Increasing the size of the mesh or screening of the chamber will also shorten response time. Thus, sensing chambers in accordance with the invention produce increased signal to noise ratios as a result of a combination of reduced sensing region volume, and appropriately selected screen or mesh size in combination with the symmetry of the sensing region and the protrusions in the optical conduits which reduce background chamber noise.

Numerous other advantages and features of the present invention will become readily apparent from the following detailed description of the invention and the embodiments thereof, from the claims and from the accompanying drawings.

BRIEF DESCRIPTION OF THE DRAWINGS

FIG. 1 is a perspective, exploded, view of a detector in accordance with the present invention;

FIG. 2 is a top plan view of the sensing chamber of FIG. 1 taken along plane 2—2;

DETAILED DESCRIPTION OF THE PREFERRED EMBODIMENTS

Figure 3:
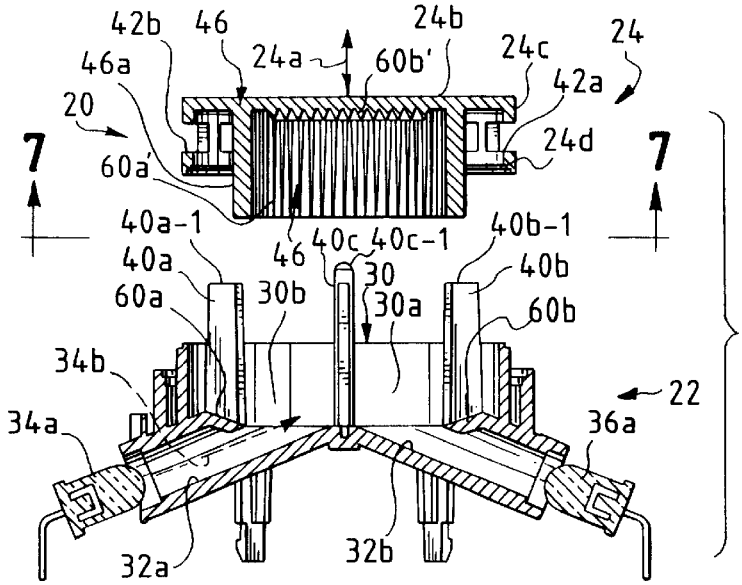
FIG. 3 is an enlarged, side, sectional, exploded view of a sensing chamber of the detector of FIG. 1.

While this invention is susceptible of embodiment in many different forms, there are shown in the drawing and will be described herein in detail specific embodiments thereof with the understanding that the present disclosure is to be considered as an exemplification of the principles of the invention and is not intended to limit the invention to the specific embodiments illustrated.

FIG. 1 illustrates a fire detector 10 in accordance with the present invention. The detector 10 includes an exterior enclosure 12 which might have a substantially cylindrical shape.

The enclosure 12 has a mounting base or mounting surface 12*a* and a central opening 12*b*. A removable top 14 extends into the opening 12*b* and can be removably attached to the enclosure 12.

The top 14 includes a plurality of open regions, 14*a*, 14*b* which permit the ingress and egress of ambient atmosphere into the enclosure 12. It will be understood that the exact configuration of the enclosure 12 and the top 14 are not limitations of the present invention.

When the top 14 has been removed by moving it away from the enclosure 12 in a direction 14*c*, access is provided to a fire sensor 20. The fire sensor 20, as described further below, includes a small, low profile sensing chamber which responds to the presence of airborne particulate matter which enters and leaves the sensor 20 via cover 14.

Sensor 20 includes a generally cylindrical base section 22 and a removable cover section 24. The cover section 24 extends through opening 12*b*. Once top 14 has been removed, section 24 is readily removable for maintenance and service purposes. The section 24 slideably engages base section 20 as discussed in more detail subsequently.

Base section 20 is carried on a printed circuit board 26. The printed circuit board 26 also carries electronic circuitry 28 for purposes of receiving signals from the fire sensor 20 and for carrying out control and communications functions of a type associated with fire sensors as would be known to those of skill in the art. It will be understood that the exact configuration of the control circuitry 28 is not a limitation of the present invention. A light emitting diode 28*a* coupled to circuitry 28 can be used to provide status information.

Figure 4:
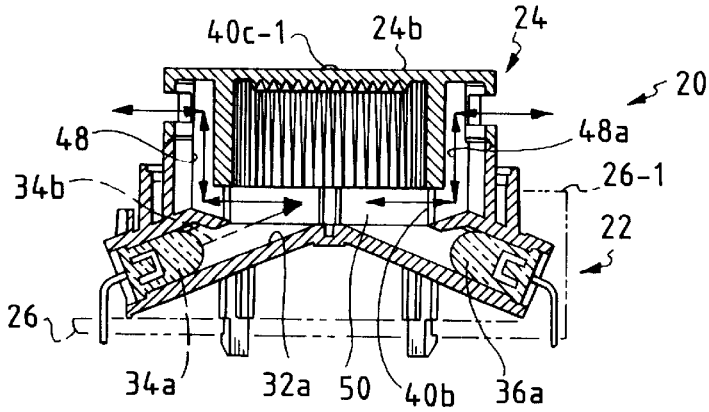
FIG. 4 is an enlarged, side, sectional, assembled view of the sensing chamber of FIG. 2.
Figure 5:
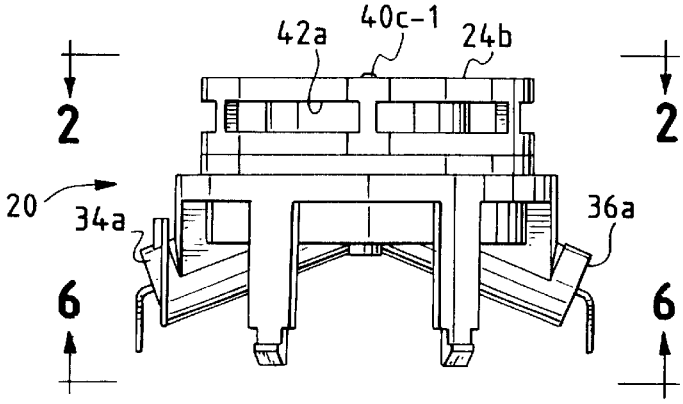
FIG. 5 is a side elevational view of the sensing chamber of the detector of FIG. 1.
Figure 6:
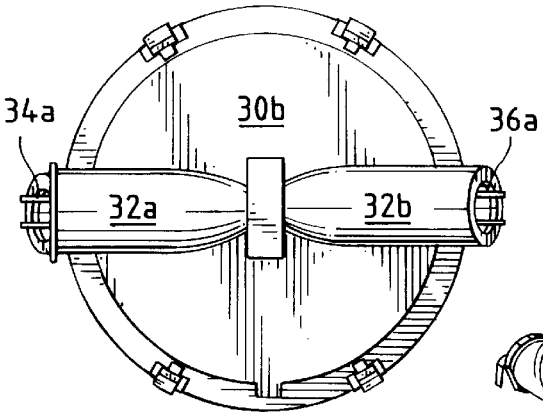
FIG. 6 is a bottom view of the sensing chamber of FIG. 5 taken alone plane 6—6.
Figure 8:
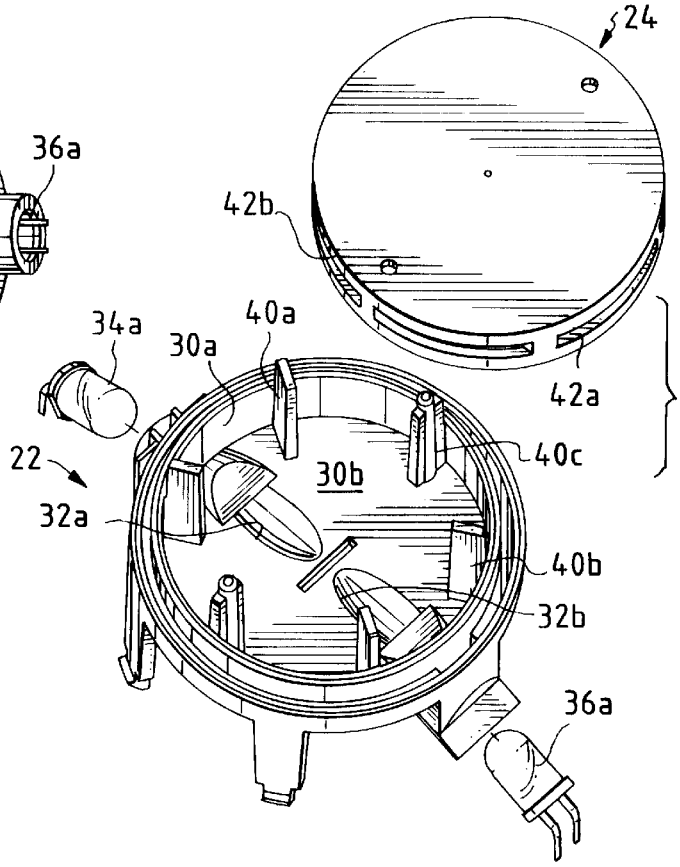
FIG. 8 is a perspective, exploded, view of the sensing chamber of FIG. 1.
Figure 7:
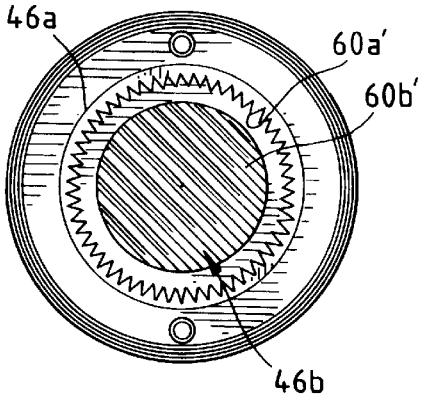
FIG. 7 is a view of the interior of the cover of the sensing chamber of FIG. 1 taken along plane 7—7.
Figure 9:
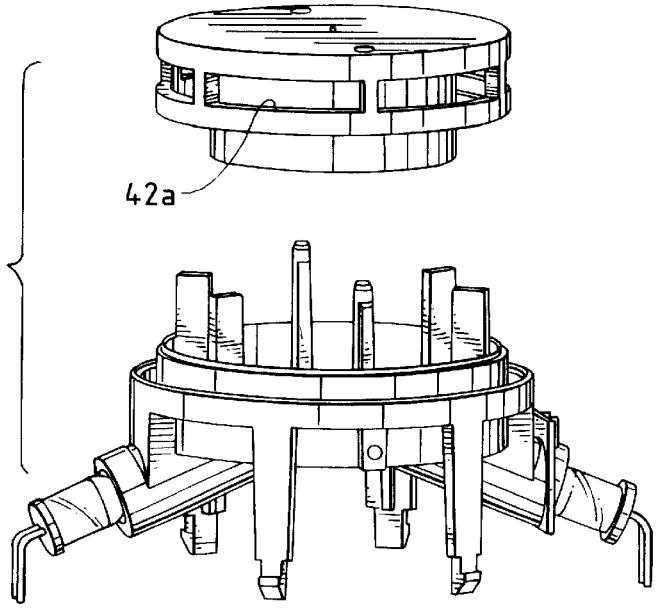
FIG. 9 is a different perspective, exploded, view of the chamber of FIG. 1.

FIGS. 2–9 illustrate various features of the sensor 20. As illustrated in FIGS. 3 and 4, base section 22 carries a cylindrical portion 30 with a side wall 30*a* which terminates at a planar end 30*b*. As illustrated, the fire sensor 20 is implemented as a scattering-type photoelectric smoke sensor. Conduits 32*a* and 32*b* are molded into base section 22 and extend from end surface 30*b* away from the cylindrical side wall 30*a*.

One of the conduits, such as conduit 32*a*, can receive a source of radiant energy, which might be a light emitting diode or a laser diode without limitation, 34*a*. When energized, the source 34*a* projects a beam of radiant energy 34*b*, illustrated in phantom in FIG. 3, through conduit 32*a* and into a sensing region 50.

Base section 22 also carries a sensor 36*a*, which could be implemented as a photodiode or a phototransistor, in the conduit 32*b*. It will be understood that the exact choices of source 34*a* and sensor 36*a* are not limitations of the present invention.

As a result of the conduit 32*b*, the field of view of sensor 36*a* is directed toward a region formed in sensor 20 which is 180° away from the region of incidence of the radiant energy 34*b* from the source 34*a*. By so-orienting the source and the sensor, stray reflections are minimized.

It will be understood that as a result of off-setting the conduits 32*a*, 32*b* from the base 30*b* of the cylindrical 30, the cylinder 30 bounds, in part a symmetrical or cylindrical sensing region 50. The region 50 is free from intrusion by either the source 34*a* or the sensor 36*a*.

Extending from surface 30*b* are elongated support elements 40*a*, 40*b* which are substantially identical. Between the elements 40*a*, 40*b* is a support and engaging element 40*c*.

The cylindrical cover element 24 includes an exterior top surface 24*b* which terminates at circumferential edges 24*c*, 24*d*. The edges 24*c*, 24*d* bound a plurality of openings such as openings 42*a*, 42*b* which extend peripherally about the cover 24.

The openings 42*a*, 42*b* permit the ingress and egress of ambient air which in turn may be carrying fire indicating gases or particulate matter. The openings 42*a*, 42*b* could be completely open or could be closed in part by mesh having openings of various sizes.

Smaller mesh sizes are known to more effectively exclude undesirable airborne material such as dust, airborne fibers, insects or the like. For example, screen openings on the order of 0.017 inches or 0.43 mm can be used without unduly delaying the response of the chamber 20. Hence, the openings 42 which are circumferentially spaced around the entire upper edge of the cover 24 provide symmetrical access to the chamber 20 by ambient atmosphere as discussed in more detail subsequently.

The cover element 24 carries thereon a cylindrical section 46 which extends substantially perpendicularly from the exterior end surface 24*b*. The cylindrical section 46 is hollow defining a grooved interior region indicated generally at 46*b*.

As the cover portion 24 moves toward the base portion 22, it ultimately becomes supported by and rests on upper surfaces 40*a*-1 and 40*b*-1. Additionally, cover portion 24 slideably and lockingly engages upper latching member 40*c*-1. Hence, the cover portion 24 is symmetrically supported and removably attached to body portion 22.

In this configuration, as illustrated in FIG. 4, an annular conduit 48 exists between the side wall 30*a* formed in base member 22 and exterior peripheral surface 46*a* of cylindrical element 46. Annular conduit 48 permits inflow and outflow of ambient airborne gases and smoke related particulate matter in a generally U-shaped flow pattern 48*a* in and out of the openings 42*a*, 42*b*. Flow is along the channel 48 formed by surfaces 30*a* and 46*a* and into the sensing region 50.

The flow regions for ingress and egress of ambient airborne gases and particulate matter are symmetrical about the chamber 20. The sensing region 50 is also symmetrical about a centerline thereof without any distortion thereof or intrusion thereinto of the source 34*a* and the sensor 36*a*. The nested cylindrical structure of the chamber 20 also contributes to the exclusion of stray exterior light.

Airborne particulate matter which enters the sensing region 50 will in turn cause scattering of the radiant energy 34*b*. The scattered radiant energy will in turn be sensed by sensor 36*a* using electronics 28 in a known fashion.

The optical axis of the emitter or source 34*a* relative to the optical axis of the center 36*a* is oriented preferably on the order of 25° for a laser diode. Where the source 34*a* corresponds to an infrared light emitting diode, the relative angle between the axis is preferably in a range of 40 to 45°.

Each of the conduits 32*a*, 32*b* terminates in a respective overhang 60*a*, 60*b*. The overhangs reduce noise in the chamber, as detected at sensor 36*a*, more than they reduce the signal sensed thereby due to airborne particulate matter. Hence, they enhance the chamber signal to noise ratio.

The emitter conduit 32*a* in combination with overhang 60*a* contributes to focusing the beam 34*b* into the sensing volume or region 50. This beam 34*b* will ultimately be incident on grooves 60*a* formed within cover 24.

Preferably overhang 60*b* associated with sensor 36*a* will extend into the conduit 32*b* enough to prevent the sensor from directly receiving any scattered light from grooves 60*b*′ that originated from the source 34*a*. The overhang 60*b* blocks the first reflection of any such scattered light. The optical axis of sensor 36*a* impinges on grooves 60*a* 180° away from where the beam 34*b* impinges thereon. This also enhances the signal-to-noise ratio.

Preferably, the overhangs in the conduits 32*a*, 32*b* will represent 20–40 percent of the cross sectional area of the respective conduit. A 27 percent intrusion into the respective conduit is preferred.

The chamber 20 benefits from relatively rapid response to inflowing airborne particulate matter due to its relatively small volume, on the order of 20 cc or less.

Representative chamber parameters are on the order of less than 1.5 inches in diameter with a sensing volume height of less than 0.7 inches to produce the noted 20 cc sensing volume. Compatible mesh sizes will be on the order of 0.013–0.02 inches. A preferred size is on the order of 0.017 inches.

Those of skill in the art will understand that the size of the openings of the mesh can be altered to effect chamber response. Somewhat larger openings will provide faster response to low energy fires at the cost of potentially permitting increased dust flow or insect problems in the chamber.

With respect to FIG. 4, a shield 26-1 is illustrated in phantom associated with sensor 36a. Such shields could be formed out of a conductive material such as metal. Alternately, base portion 22 could be molded of conductive plastic to provide a shield about the sensing element 36*a*. This will provide an AC ground about the chamber 22 and the sensor 36*a*. In one embodiment, contacts might be molded into the conductive plastic to create connections to the shield.

One of the advantages of the chamber 20 lies in the fact that the side walls of cylindrical members 30 and 46 are continuous and unperforated. They do not exhibit labyrinth-type openings therethrough. These side walls block outside ambient light from reflecting into the interior of sensing region 50 and contributing to noise which might be incident upon sensing element 36*a*. The mesh and the openings 42*a*, 42*b* can be molded into the cover portion 24. The cylindrical peripheral openings 42*a*, 42*b* provide access to the symmetrical annular flow channel 48 between the cylindrical side walls 30*a* and 46*a* into and from sensing region 50.

Additionally, internal grooves 60*a*′ and 60*b*′ can be provided in the side walls of the cylindrical member 46 as well as in the end portion. The grooves are very effective in absorbing light originating from the source 34*a* as well as any reflections from outside of the chamber. In addition, the number of required reflections for exterior light to enter the sensing region 50 is high enough so as to substantially eliminate such interference. The grooves also trap internal chamber dust and contribute to an enhanced signal-to-noise ratio.

As noted previously, the cover portion 24 extends through opening 12*b* of the enclosure 12. Hence, cover portion 24 can be slideably removed from base portion 22 and replaced. This process will not only provide a dust free interior side wall 46*b* but it can be achieved without disturbing the source 34*a* or the sensor 36*a*.

The out of phase orientation of the offset source 34*a* and sensor 36*a*, the symmetrical annular inflow/outflow channel and non-perforated side walls with internal reflection suppressing grooves each contribute to a relatively low volume, symmetrical sensing region with an acceptable signal-to-noise ratio. Readily separable and replaceable cover 24 facilitates maintenance. The small chamber size results in an aesthetically acceptable, low profile detector.

Various sizes of mesh can be molded into covers 24 to vary chamber performance characteristics. The relatively small sensing chamber volume makes feasible the use of relatively small mesh sizes yet the chamber exhibits acceptable response levels and adequate signal-to-noise ratios.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

What is claimed is:

1. A smoke detector comprising:

a housing;

a smoke sensing chamber centrally located and extending in part through a central opening in the housing wherein a circumferential region of the chamber, which extends from the central opening, carries a peripherally disposed plurality of openings for ingress to and egress from the chamber within the housing wherein the circumferential region is removable from the chamber via the central opening and wherein the circumferential region carries a cylindrical bounding sidewall which extends axially therefrom wherein the bounding sidewall has a non-perforated peripheral surface.

2. A detector as in claim 1 wherein the bounding sidewall terminates in an open end displaced axially from the openings.

3. A detector as in claim 1 wherein the sensing chamber has a base fixed in the housing and wherein the base receives the open end thereby forming an enclosed, symmetrical, sensing volume in flow communication with ambient atmosphere, outside of the housing.

4. A detector as in claim 3 wherein the base carries an emitter and a sensor outside of the sensing volume.

5. A detector as in claim 4 wherein the emitter and sensor are each located in an optical conduit wherein the conduits each extend, at a selected angle, relative to the base.

6. A detector as in claim 5 wherein the emitter projects a beam of radiant energy through the respective conduit into the sensing region.

7. A detector as in claim 6 wherein the sensor is aligned along an axis of the respective conduit and wherein the axis of the conduit intersects the beam of radiant energy at a selected angle in the sensing region.

8. A detector as in claim 7 wherein the angle falls in a range of twenty to fifty degrees.

9. A detector as in claim 6 wherein the beam impinges on a portion of the bounding sidewall.

10. A detector as in claim 9 wherein an axis of the sensor intersects the bounding sidewall substantially 180 degrees away from where the beam impinges the sidewall.

11. A detector as in claim 3 wherein a cylindrical flow region is formed between the base and the cylindrical bounding side wall.

12. A smoke detector comprising:

a housing;

a smoke sensing chamber extending in part through a central opening in the housing wherein a circumferential region of the chamber, which extends from the central opening, carries a peripherally disposed plurality of openings for ingress to and egress from the chamber within the housing wherein the circumferential region is removable from the chamber via the central opening and wherein the circumferential region carries a cylindrical bounding sidewall which extends axially therefrom wherein the bounding sidewall has a non-perforated peripheral surface.

13. A detector as in claim 12 wherein the bounding sidewall terminates in an open end displaced axially from the openings.

14. A detector as in claim 12 wherein the sensing chamber has a base fixed in the housing and wherein the base receives the open end thereby forming an enclosed, symmetrical, sensing volume in flow communication with ambient atmosphere, outside of the housing.

15. A detector as in claim 14 wherein the base carries an emitter and a sensor outside of the sensing volume.

16. A detector as in claim 15 wherein the emitter and sensor are each located in an optical conduit wherein the conduits each extend, at a selected angle, relative to the base.

17. A detector as in claim 16 wherein the emitter projects a beam of radiant energy through the respective conduit into the sensing region.

18. A detector as in claim 17 wherein the sensor is aligned along an axis of the respective conduit and wherein the axis of the conduit intersects the beam of radiant energy at a selected angle in the sensing region.

19. A detector as in claim 18 wherein the angle falls in a range of twenty to fifty degrees.

20. A detector as in claim 17 wherein the beam impinges on a portion of the bounding sidewall.

21. A detector as in claim 20 wherein an axis of the sensor intersects the bounding sidewall substantially 180 degrees away from where the beam impinges the sidewall.

22. A detector as in claim 14 wherein a cylindrical flow region is formed between the base and the cylindrical bounding side wall.

23. A detector as in claim 12 wherein the sensing chamber comprises:

a base having a first cylinder extending therefrom wherein the cylinder is formed with a continuous, non-perforated peripheral surface;

wherein the cylinder and the bounding sidewall are positioned on a common center line thereby forming a substantially closed interior sensing region bounded thereby with an annular flow path therebetween.

24. A detector as in claim 23 wherein a flow path extends from the plurality of openings, between the bounding sidewall and the cylinder into the sensing region.

25. A detector as in claim 12 wherein the sensing chamber comprises:

a source of radiant energy.

26. A detector as in claim 12 wherein the bounding side wall carries a plurality of grooves on an internal surface.

27. A detector as in claim 25 which includes a sensor of radiant energy, displaced from the source and oriented at a selected angle thereto.

28. A detector as in claim 27 wherein the angle is in a range of 20–30 degrees.

29. A detector as in claim 28 wherein the angle is on the order of 25 degrees.

30. A detector as in claim 27 wherein both the sensor and the source are located at the one end adjacent to but outside of an interval sensing region.

31. A detector as in claim 30 wherein each of the sensor and the source define an optical axis and wherein these axes intersect in the sensing region at an angle between 20 and 50 degrees.

32. A sensing chamber as in claim 31 wherein the angle of intersection corresponds to a scattering angle in a range of 40–50 degrees.

33. A detector as in claim 31 wherein the sensing region is symmetrical and not distorted by the source or sensor intruding thereinto.

34. A sensing chamber as in claim 30 wherein the sensor and source are positioned in conduits at one end wherein one conduit focuses the radiant energy from the source and another focuses radiant energy toward the sensor.

35. A detector as in claim 23 wherein at least the conduit associated with the sensor incorporates a conduit constricting protrusion whereby the sensor is shielded from selected reflective radiant energy in the housing.

36. A smoke detector comprising:

a housing;

a smoke sensing chamber extending in part through an opening in the housing wherein a circumferential region of the chamber, which extends from the opening, carries a peripherally disposed plurality of openings for ingress to and egress from the chamber within the housing and wherein the circumferential region carries a cylindrical bounding sidewall which extends axially therefrom wherein the bounding sidewall has a non-perforated peripheral surface.

37. A detector as in claim 36 wherein the bounding sidewall terminates in an open end displaced axially from the openings.

38. A detector as in claim 37 wherein the sensing chamber has a base fixed in the housing and wherein the base receives the open end thereby forming an enclosed, symmetrical, sensing volume in flow communication with ambient atmosphere, outside of the housing.

39. A detector as in claim 37 wherein the sensing chamber has a base fixed in the housing and wherein the base receives the open end thereby forming an enclosed, symmetrical, sensing volume in flow communication with ambient atmosphere, outside of the housing.

40. A detector as in claim 39 further including an emitter and a sensor wherein each is located in an optical conduit wherein the conduits each extend, at a selected angle, relative to the base.

41. A detector as in claim 40 wherein the emitter projects a beam of radiant energy through the respective conduit into the sensing region.

42. A detector as in claim 41 wherein the sensor is aligned along an axis of the respective conduit and wherein the axis of the conduit intersects the beam of radiant energy at a selected angle in the sensing region.

43. A detector as in claim 42 wherein the angle falls in a range of twenty to fifty degrees.

44. A detector as in claim 41 wherein the beam impinges on a portion of the bounding sidewall.

45. A detector as in claim 44 wherein an axis of the sensor intersects the bounding sidewall substantially 180 degrees away from where the beam impinges the sidewall.

46. A detector as in claim 38 wherein a cylindrical flow region is formed between the base and the cylindrical bounding side wall.

47. A detector as in claim 38 wherein the base is cylindrical with a length and a radius wherein the length is on the order of the radius.

48. A detector as in claim 36 wherein the circumferential region is removable from the chamber.

49. A detector as in claim 36 wherein the opening in the housing is centrally located in the housing.

50. A smoke detector comprising:

a housing;

a cylindrical sensor, carried by the housing, having a continuous closed peripheral sidewall with first and second ends and with a length on the order of a radius of the housing, the sensor including:

a source of radiant energy positioned in one of the ends;

a cover substantially closing the other end with at least one opening, displaced axially from the one end, located adjacent to the other end permitting a flow of adjacent atmosphere into and out of the sensor.

51. A detector as in claim 50 which includes a plurality of openings, spaced about the sensor at the other end.

52. A detector as in claim 50 wherein the sensor includes a base at the one end wherein the base receives a cylindrical insert which carries the cover and wherein the insert in conjunction with the base, defines an internal region into which the source injects radiant energy.

53. A detector as in claim 52 wherein the insert is slidably received by the base.

54. A detector as in claim 52 wherein the insert carries a plurality of grooves on an internal surface.

55. A detector as in claim 52 which includes a receiver of radiant energy, displaced from the source and oriented at a selected angle thereto.

56. A detector as in clam 55 wherein the angle is in a range of 20–30 degrees.

57. A detector as in claim 55 wherein each of the receiver and the source define an optical axis and wherein these axes intersect in the sensing region at an angle between 20 and 50 degrees.

* * * * *